US005924596A

United States Patent [19]

Kaufman

[11] Patent Number: 5,924,596

[45] Date of Patent: Jul. 20, 1999

[54] METHOD AND APPARATUS FOR DISPENSING PROMOTIONAL AND PRODUCT ITEMS

[75] Inventor: Mark S. Kaufman, Stamford, Conn.

[73] Assignee: 3-Strikes Custom Design, Stamford, Conn.

[21] Appl. No.: 08/869,028

[22] Filed: Jun. 4, 1997

[51] Int. Cl.[6] ..... G07F 11/00

[52] U.S. Cl. ..... 221/312 C; 221/312 R; 206/497; 206/457; 206/278; 229/87.17

[58] Field of Search ..... 221/312 C, 312 R, 221/208, 289, 210, 265; 229/87.17, 87.15; 206/497, 278, 217, 457

[56] References Cited

U.S. PATENT DOCUMENTS

| | | | |
|---|---|---|---|
| 1,863,001 | 6/1932 | Barok et al. | 221/312 C |
| 2,614,673 | 10/1952 | Obodzinski | 221/265 |
| 2,664,227 | 11/1953 | Probasco | 221/265 |
| 2,772,811 | 12/1956 | Schaef | 221/312 C |
| 2,880,906 | 4/1959 | Probasco | 221/265 |
| 2,990,975 | 7/1961 | Sereno | 221/265 |
| 3,085,712 | 4/1963 | Skumawitz | 221/312 R |
| 3,286,831 | 11/1966 | Giberstein | 206/278 |
| 3,354,576 | 11/1967 | Gralnick | 206/278 |
| 3,374,882 | 3/1968 | Amaliksen | 206/497 |
| 3,747,746 | 7/1973 | Newman et al. | 206/497 |
| 3,948,416 | 4/1976 | Housman . | |
| 4,347,952 | 9/1982 | Bookout | 221/289 |
| 4,702,392 | 10/1987 | Rachman . | |
| 5,056,659 | 10/1991 | Howes et al. | 206/217 |
| 5,080,256 | 1/1992 | Rockola | 221/312 R |
| 5,445,287 | 8/1995 | Center et al. . | |
| 5,505,332 | 4/1996 | Vogelpohl et al. . | |
| 5,593,029 | 1/1997 | Both | 206/278 |
| 5,692,606 | 12/1997 | Elmaleh | 206/278 |
| 5,728,415 | 3/1998 | Troska | 206/217 |
| 5,813,538 | 9/1998 | Kaufman | 206/278 |

FOREIGN PATENT DOCUMENTS

| | | | |
|---|---|---|---|
| 0133764 | 6/1991 | Japan | 206/497 |

*Primary Examiner*—H. Grant Skaggs
*Attorney, Agent, or Firm*—St. Onge Steward Johnston & Reens LLC

[57] ABSTRACT

A method and apparatus for dispensing promotional and product items is provided, which includes an item dispensing machine. The item dispensing machine includes a payment receipt mechanism, a storage compartment storing the promotional and product items, and a dispensing mechanism. The promotional item and the product item are substantially the same size and shape. Upon receipt of a predetermined payment amount by the payment receipt mechanism, the machine dispenses either the promotional item or the product item, depending upon which item was in position for dispensing. The promotional item includes a preselected monetary amount.

12 Claims, 2 Drawing Sheets

METHOD AND APPARATUS FOR DISPENSING PROMOTIONAL AND PRODUCT ITEMS

FIELD OF THE INVENTION

The invention relates to a method and apparatus for dispensing items upon receipt of payment, and more specifically, to a method and apparatus for dispensing promotional and product items upon receipt of payment to increase sales of the product item.

BACKGROUND OF THE INVENTION

Vending machines and methods of dispensing product items from vending machines are well-known in the art. For example, U.S. Pat. Nos. 3,948,416 and 4,702,392 disclose vending machines, and U.S. Pat. Nos. 5,445,287 and 5,505,332 disclose methods of dispensing product items from vending machines.

Although the prior art discloses vending apparatus that is generally useful for their limited purpose, i.e., dispensing product items upon receipt of payment, the prior art does not disclose a vending apparatus which efficiently and effectively markets the product items which it offers for sale.

The use of promotional items has proliferated in today's increasingly competitive marketplace, where companies are constantly seeking more effective and cost efficient ways to market their products to consumers. Effective marketing is oftentimes the determinative factor between failure and success for a product. The advantage to be proffered by a vending apparatus dispensing both promotional and product items is the increased sales of the product item resulting from the increased exposure created by the promotional item.

What is desired, therefore, is a method and apparatus for dispensing promotional and product items upon receipt of payment where a promotional item containing a preselected monetary amount is dispensed to provide increased incentive to purchase the product item.

SUMMARY OF THE INVENTION

Accordingly, it is an object of the invention to provide a method for dispensing both promotional and product items.

Another object of the invention is to provide a method for dispensing promotional and product items which have substantially the same size and shape.

Yet another object of the invention is to provide a method for dispensing promotional and product items, where the promotional item contains a monetary amount.

Still another object of the invention is to provide a method for dispensing both promotional and product items, where the promotional item displays thereon the logo and/or trademark associated with the product item.

These and other objects of the invention are achieved by a method and apparatus for dispensing promotional and product items which includes an item dispensing machine. The item dispensing machine includes a payment receipt mechanism, a storage compartment storing the promotional and product items, and a dispensing mechanism. The promotional item and the product item are substantially the same size and shape. Upon receipt of a predetermined payment amount by the payment receipt mechanism, the machine dispenses either the promotional item or the product item, depending upon which item was in position for dispensing. The promotional item includes a preselected monetary amount.

The invention and its particular features and advantages will become more apparent from the following detailed description considered with reference to the accompanying drawings.

DETAILED DESCRIPTION OF THE INVENTION

Figure 1:
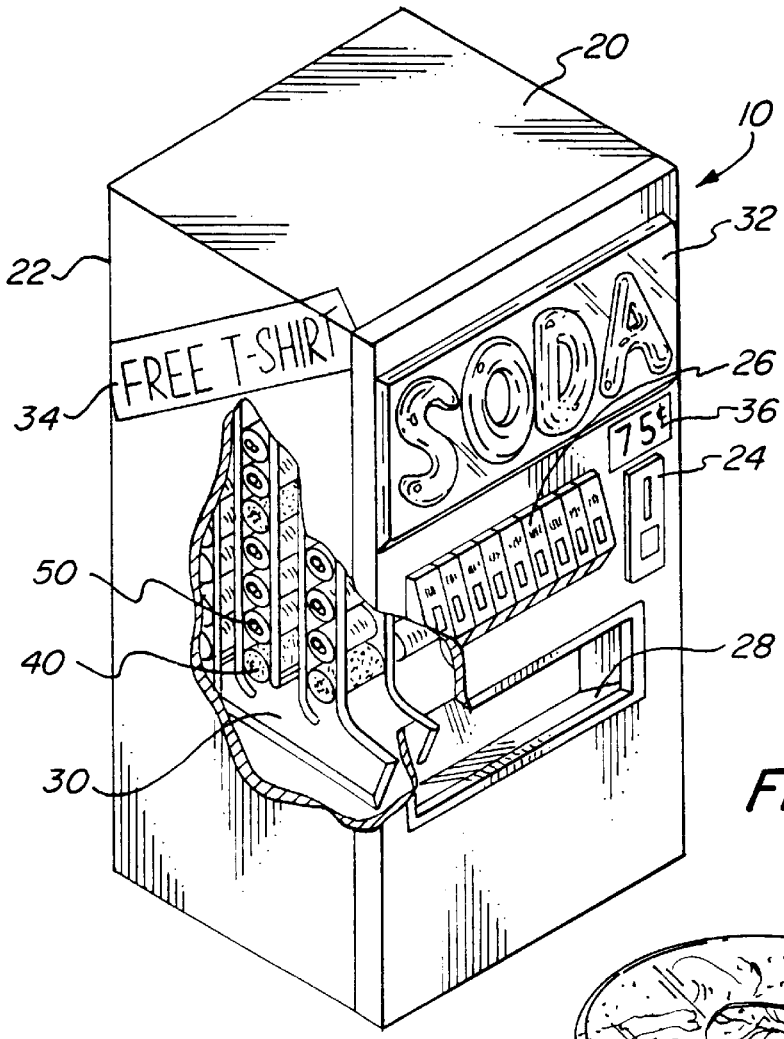
FIG. 1 is a perspective view of one embodiment of an apparatus for dispensing promotional and product items in accordance with the invention, where a cutaway portion reveals the promotional and product items.

FIG. 1 shows one embodiment of an apparatus for dispensing promotional and product items 10 in accordance with the invention, which includes an item dispensing machine 20. The item dispensing machine 20 includes a housing 22, a payment receipt mechanism 24, an item selection panel 26, an item dispensing outlet 28, and a storage compartment 30. The item dispensing machine 20 also includes a front housing member 32 which is preferably pivotally attached to the housing 22 to provide access to the interior of the item dispensing machine 20.

The storage compartment 30 is shown storing promotional items 40 as well as product items 50. As shown, the size and the shape of the promotional item 40 and the product item 50 are preferably substantially the same. This permits storage of the promotional items 40 and the product items 50 in the same storage compartment 30. Furthermore, because of the substantial similarity in size and shape of the promotional items 40 and the product items 50, these items 40, 50 may be positioned in the storage compartment 30 in any order and arrangement. However, it should be understood that vending machines are sensitive to size, product configuration, weight and weight distribution. Thus, the promotional item must be capable of being dispensed, and need not be identical in size and weight in comparison to the product.

In FIG. 1, the item dispensing machine 20 is illustrated as a soda vending machine. Accordingly, the product items 50 are soda containers, shown as cans of soda. It should be noted that the depiction of the item dispensing machine 20 as a soda vending machine is for illustrative purposes only.

Figure 2:
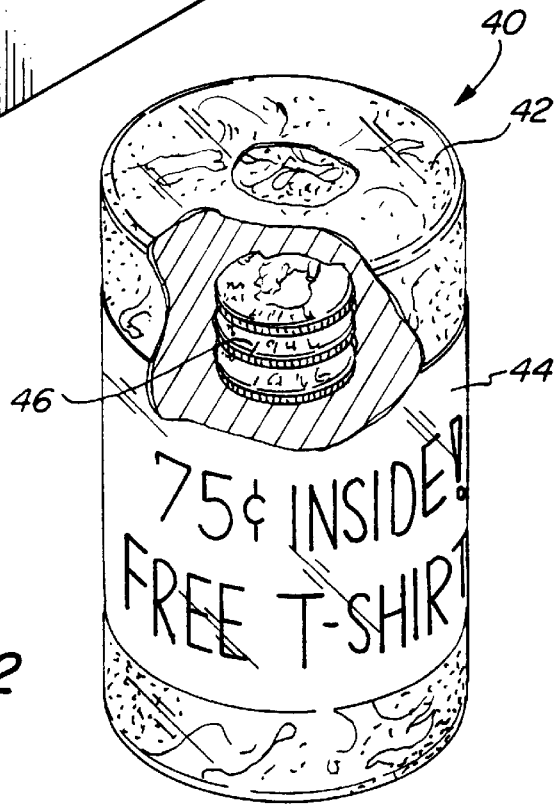
FIG. 2 is a perspective view of the promotional item of FIG. 1, where a cutaway portion reveals money contained therein.

Referring now to FIG. 2, there is shown the promotional item 40 of FIG. 1. Preferably, the promotional item 40 is a compressed fabric article bearing the logo and/or the trademark associated with the product item 50. The compressed fabric article may be, by way of example, a T-shirt, towel, hat, boxer shorts, apron, smock, socks, underwear or visor. For the embodiment of the invention shown in FIG. 1, the promotional item 40 is a compressed T-shirt, as announced by a promotional banner 34 attached to the housing 22.

The compression technology as applied to fabric articles is well-known in the art. Generally, the fabric article to be compressed is placed in a mold, and a piston under substantial pressure compresses the fabric article into the shape of a cylinder, rectangle or whatever shape the mold is designed to produce.

The promotional item 40 includes a packaging material 42 which is preferably a sheet of transparent material, such as a sheet of transparent polymeric material. This transparent material is known in the field as shrink-wrap. Also included as part of the promotional item 40 is a label 44 which has appearing thereon the marketing indicia, such as the logo and/or the trademark associated with the product item 50 (not shown). The label 44 may be positioned between the compressed fabric article and the packaging material 42 or may be positioned directly on the packaging material 42. The label is typically printed paper with the colors and logo of the product being dispensed.

Within the compressed fabric article is a preselected amount of money 46. This monetary amount 46 is incorporated into the fabric article compression process so that it is contained in the compressed fabric article. In FIG. 2, the preselected monetary amount 46 is 75 cents, which corresponds to the purchase price for the product item 50 as shown in FIG. 1 by a product price label 36. As will be described hereinbelow, the preselected monetary amount 46, while preferably equivalent to the purchase price for the product item 50, need not be so. Also, the monetary amount 46 need not take the form of cash. It may, for example, take the form of a redeemable couple for the preselected amount. Label 44 announces the amount of money contained in the compressed fabric article. The monetary amount 46 may be imbedded in the fabric article or may be placed on the exterior under the shrink-wrap material. The money 46 may be used to purchase the soda after the promotional T-shirt is received.

If a coupon or token, rather than case, is associated with the product, it is preferred that the vending machine accept the coupon or token immediately so the person purchasing the item can place the token or coupon in the vending machine and receive the desired product.

The operation of the apparatus 10 of FIG. 1 is as follows. The storage compartment 30 of the item dispensing machine 20 is loaded with both promotional 40 and product 50 items via the front housing member 32. The number and arrangement of the promotional items 40 loaded in the storage compartment 30 are determined by a person loading the items 40, 50. Preferably, this determination is based upon whatever number and arrangement of the promotional items 40 as shown by experiment will most increase the sales of the product items 50. Usually the promotional items 40 are placed randomly. The ratio of product to promotional item may vary, but a ratio between 100 to 1 and 5 to 1 provides adequate incentive for the purchaser.

When a purchaser inputs the purchase price indicated by the product price label 36 into the payment receipt mechanism 24 and makes a selection from the item selection panel 26, the next item 40, 50 in position for dispensing is dispensed to the item dispensing outlet 28. This dispensed item may be either the product item 50 or the promotional item 40.

If the item dispensed is the promotional item 40, the purchaser not only receives a free item but is also provided with money 46 with which to purchase the product item 50. As discussed above, the preselected monetary amount 46 is preferably equivalent to the purchase price for the product item 50 so that the purchaser can, following receipt of the promotional item 40, purchase the product item 50. However, the monetary amount 46 contained in the compressed fabric article may be any preselected amount.

Figure 3:
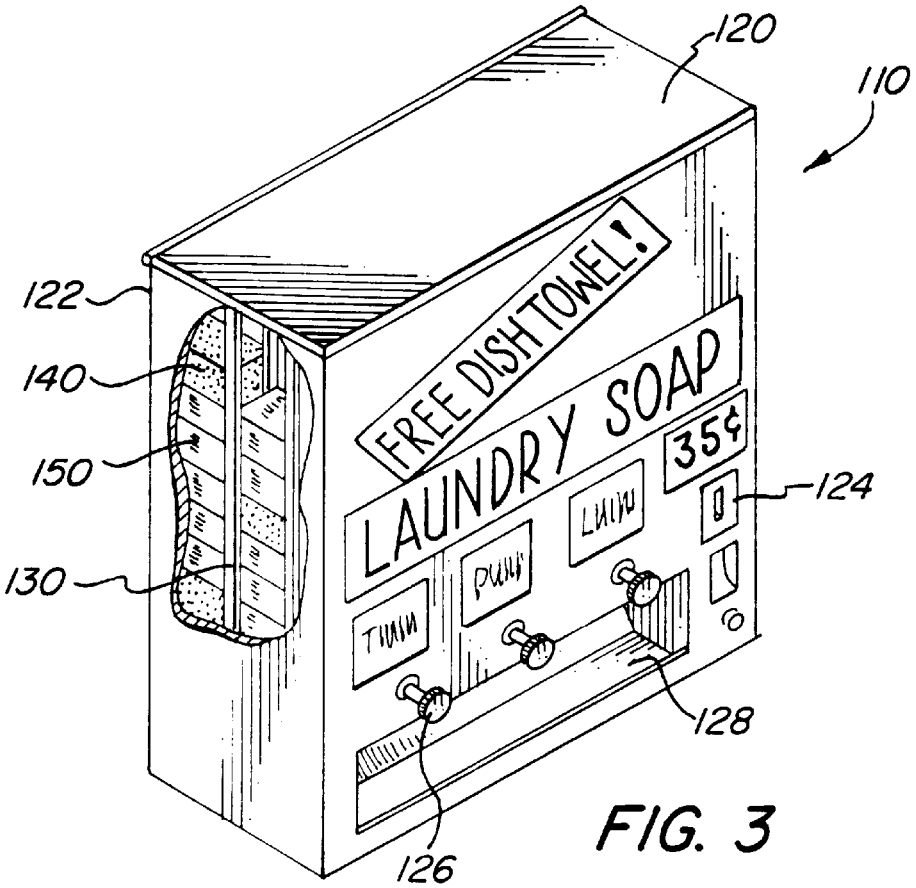
FIG. 3 is a perspective view of another embodiment of an apparatus for dispensing promotional and product items in accordance with the invention, where a cutaway portion reveals the promotional and product items.

FIG. 3 shows another embodiment of an apparatus for dispensing promotional and product items 110 in accordance with the invention. The apparatus 110 includes an item dispensing machine 120, which is depicted for illustrative purposes only as a laundry detergent dispenser. The dispenser 120 includes a housing 122, a payment receipt mechanism 124, item selectors 126, an item dispensing outlet 128, and a storage compartment 130. The storage compartment 130 stores promotional items 140 as well as product items 150. The product items 150 are illustrated as boxes of laundry detergents. The size and shape of the promotional item 140 and the product item 150 are substantially the same.

Figure 4:
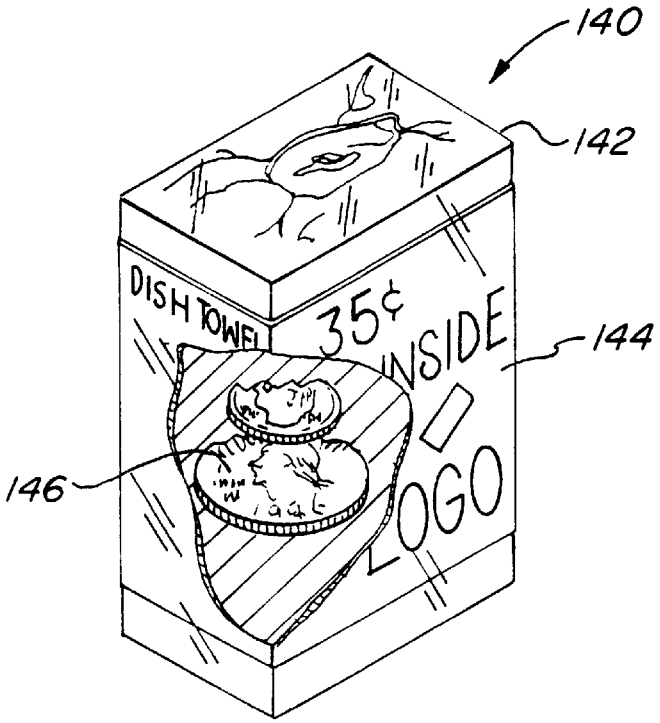
FIG. 4 is a perspective view of the promotional item of FIG. 3, where a cutaway portion reveals money contained therein.

Referring to FIG. 4, there is shown the promotional item 140 of FIG. 3. Unlike the promotional item 40 of FIG. 2, this promotional item 140 is rectangular in shape, to imitate the shape of the box of laundry detergent 150. The promotional item 140 includes a packaging material 142, preferably the sheet of transparent polymeric material, a label 144 having thereon the logo and/or the trademark associated with the product item 150, and a preselected amount of money 146, in this case 35 cents, which preferably corresponds to the purchase price for the product item 150.

The operation of the apparatus 110 of FIG. 3 is similar to the operation of the apparatus 10 of FIG. 1. Note that by providing appropriate promotional items with a wide variety of product items, various different groups of purchasers can be targeted for more effective and efficient marketing.

It is to be understood that although specific embodiments of the invention have been described herein in detail, such description is for purposes of illustration only and modifications may be made thereto by those skilled in the art within the scope of the invention.

What is claimed is:

1. An apparatus for dispensing product items and periodically dispensing promotional items, which comprises:

an item dispensing machine comprising:

a payment receipt mechanism;

a storage compartment; and a dispensing mechanism for dispensing a product item one at a time;

each said product item having a predetermined size and shape stored in said storage compartment, said product item dispensable via said dispensing mechanism upon receipt of a predetermined payment amount by said payment receipt mechanism;

at lease one promotional item of substantially the predetermined size and shape of said product item stored in said storage compartment among said product items, said promotional item being dispensable via said dispensing mechanism upon receipt of the predetermined payment amount by said payment receipt mechanism; and said promotional item containing a preselected monetary amount sufficient in amount to allow the purchase of at least one of said product items, and being in a form that would be accepted by said dispensing machine to vend a desired product item.

2. The apparatus of claim 1, wherein said promotional item further comprises a package having a label with logo and/or trademark associated with said product item appearing thereon and wherein the promotional item has substantially the predetermined size and shape of said product item.

3. The apparatus of claim 1, wherein said promotional item is a compressed fabric article having a logo and/or trademark associated with said product item.

4. The apparatus of claim 3, wherein said compressed fabric article is a T-shirt.

5. An apparatus for dispensing product items and periodically dispensing promotional items, which comprises:

a vending machine comprising a payment receipt mechanism, a storage compartment for storing a set of items of substantially the same size and shape, and a dispensing mechanism for dispensing an item from said storage compartment upon receipt of payment by said payment receipt mechanism;

a product item of a predetermined size and shape stored in said storage compartment, said product item dispensable via said dispensing mechanism upon receipt of a predetermined payment amount by said payment receipt mechanism;

a promotional item of substantially the predetermined size and shape of said product item stored in said storage compartment among said product items, said promotional item dispensable via said dispensing mechanism upon receipt of the predetermined payment amount by said payment receipt mechanism;

said promotional item containing a preselected monetary amount sufficient in amount to allow the purchase of at least one of said product items, and being in a form that would be accepted by said dispensing machine to vend a desired product item; and said promotional item including a package having a label with logo and/or trademark associated with said product item appearing thereon.

6. The apparatus of claim 5, wherein the predetermined payment amount is equivalent to the preselected monetary amount.

7. The apparatus of claim 5, wherein said promotional item is a compressed fabric article having a logo and/or trademark associated with said product item.

8. The apparatus of claim 7, wherein said compressed fabric article is a T-shirt.

9. A method for dispensing product items and periodically dispensing promotional items from an item dispensing machine including a payment receipt mechanism, a storage compartment and a dispensing mechanism, which comprises the steps of:

placing a product item of a predetermined size and shape in said storage compartment for dispensing via said dispensing mechanism upon receipt of a predetermined payment amount by said payment receipt mechanism;

configuring a promotional item to be of substantially the predetermined size and shape of said product item;

placing said promotional item in said storage compartment among said product items for dispensing via said dispensing mechanism upon receipt of the predetermined payment amount by said payment receipt mechanism; and dispensing a preselected monetary amount sufficient in amount to allow the purchase of at least one of the product items, and being in a form that would be accepted by said dispensing machine to vend a desired product item, in connection with dispensing said promotional item.

10. The method of claim 9, further comprising the step of packaging said promotional item with a label having logo and/or trademark associated with said product item appearing thereon.

11. The method of claim 9, wherein the predetermined payment amount is equivalent to the preselected monetary amount.

12. A promotional item for being dispensed in designated vending machines that dispense a product item having a predetermined size and shape and having marketing indicia thereon, said promotional item comprising:

a compressed fabric article, said article having a shape and size substantially similar to said size and shape of said product item, a monetary amount associated with the fabric article, said monetary amount being sufficient in amount to allow the purchase of at least one of the product items, and being in a form that would be accepted by the designated dispensing machines to vend a desired product item, said fabric article wrapped with a sheet bearing marketing indicia substantially similar to the marketing indicia of said product item, said article, said monetary amount and said sheet being shrink wrapped.

* * * * *